US005283411A

United States Patent [19]

Sung-Wan

[11] Patent Number: 5,283,411

[45] Date of Patent: Feb. 1, 1994

[54] DRIVING CIRCUIT FOR A MICROWAVE OVEN

[75] Inventor: Ann Sung-Wan, Suwon, Rep. of Korea

[73] Assignee: Samsung Electronics Co., Ltd., Suwon, Rep. of Korea

[21] Appl. No.: 881,868

[22] Filed: May 12, 1992

[30] Foreign Application Priority Data

May 14, 1991 [KR] Rep. of Korea ..... 91-7800

[51] Int. Cl.[5] ..... H05B 6/68

[52] U.S. Cl. ..... 219/719; 323/251; 323/301; 219/760

[58] Field of Search ..... 219/10.55 B; 323/247, 323/251, 254, 301, 355

[56] References Cited

U.S. PATENT DOCUMENTS

| | | | |
|---|---|---|---|
| 4,774,451 | 9/1988 | Mehnert et al. | 323/263 |
| 4,835,353 | 5/1989 | Smith, et al. | 219/10.55 B |
| 4,866,589 | 9/1989 | Satoo et al. | 219/10.55 B |
| 4,896,093 | 1/1990 | Spires | 323/358 |
| 4,967,051 | 10/1990 | Maehara et al. | 219/10.55 B |
| 4,990,733 | 2/1991 | Joelsson et al. | 219/10.55 B |
| 4,992,637 | 2/1991 | Ishiyama | 219/10.55 B |
| 5,003,141 | 3/1991 | Braunisch et al. | 219/10.55 B |

FOREIGN PATENT DOCUMENTS

| | | | |
|---|---|---|---|
| 52-35502 | 3/1977 | Japan | 219/10.55 B |
| 61-296678 | 12/1986 | Japan . | |
| 63-269495 | 11/1988 | Japan | 219/10.55 B |

*Primary Examiner*—Philip H. Leung
*Attorney, Agent, or Firm*—Burns, Doane, Swecker & Mathis

[57] ABSTRACT

A microwave oven driving circuit for stably driving a microwave oven wherein a certain output of a magnetron can be generated by controlling a microcomputer. First and second comparing portions control a voltage supplied from a power supply portion and an output of the magnetron to increase in stages so as to obtain a normal output of the magnetron. Also, the output of the magnetron is gradually decreased without being too abrupt even if the output of the generating portion must be decreased as cooking is completed, thereby improving durability and cooking efficiency of the microwave oven.

7 Claims, 3 Drawing Sheets

DRIVING CIRCUIT FOR A MICROWAVE OVEN

BACKGROUND OF THE INVENTION

1. Field of the Invention

The present invention relates to a drive circuit for driving a magnetron equipped in a microwave oven, and more particularly, to a microwave oven driving circuit by which the magnetron output can be suitably generated when the output level of the microwave oven must be changed. The driving circuit includes a microcomputer for controlling the output level of the microwave oven at the initial operation or in a cooking process.

2. Description of the Prior Art

In general, when a power switch is turned on to operate a microwave oven, an amount of hot electrons emitted from a filament of a magnetron is very low at an initial operation, when the filament is insufficiently preheated. As a result, the normal magnetron output cannot be generated, thus resulting in a disadvantage that a secondary coil of a transformer is not loaded while a high voltage is supplied to a primary coil of the transformer.

To prevent the aforementioned situation, a conventional method involves controlling the magnetron to generate a very low output so as to not supply high voltage to the primary coil of the transformer until the normal magnetron output can be generated.

The result of the conventional method described above is that a minute current flows to the primary coil of the transformer so that the magnetron is supplied with a voltage less than an operational voltage, i.e., a threshold voltage thereof. Consequently, a problem arises in that the generating operation of the magnetron cannot be appropriately performed.

The problem is more serious where the magnetron is supplied with a voltage less than the rated voltage thereof due to a change of common power supply.

Also, during an operation of the microwave oven, when the output of the magnetron is to be changed from a high level to a low level according to a cooking program previously stored in the microwave oven (that is, when the cooking is nearly completed and a high output from the magnetron is unnecessary), a moding, phenomenon wherein the magnetron output is not generated, instantaneously occurs from a property of the magnetron, thereby deteriorating a function of the magnetron.

To solve such a problem, there is well-known a cooking method described in, for example, Japanese Patent Laid-Open Publication No. Sho 61-296678, by which a magnetron is continuously driven and an electric heater is simultaneously operated.

More particularly, a circuit arrangement of the cooking method disclosed in the Japanese patent publication, includes a rectifying circuit connected to an ac power supply; a transformer connected at its primary winding to an output terminal of the rectifying circuit a magnetron connected to a secondary winding of the transformer through a voltage multiplier comprising a capacitor and a diode; a resonance capacitor forming a resonance circuit together with the transformer; a first switching element for excitating the resonance circuit an electric heater connected to an output terminal of the rectifying circuit through a second switching element and, a control means for turning ON or OFF the first and second switching elements with a predetermined duty ratio so that the sum of the output of the electric heater and the output of the magnetron is at a predetermined value, thereby obtaining a good efficiency in heating the magnetron.

The conventional cooking method described above has the advantage that the magnetron is continuously driven and a filament is preheated by means of the electric heater, but the method has disadvantages in that a structure is complicated and power consumption is necessarily increased because of the electric heater.

SUMMARY OF THE INVENTION

Accordingly, the present invention has been made in consideration of the conventional problems as described above and a principle object of the invention is to provide a microwave oven driving circuit wherein a magnetron is first driven using a voltage above a threshold voltage of the magnetron under a control of a microcomputer at the initial operation and then is driven using a gradually increased voltage to thereby produce a normal output of the magnetron.

Another object of the present invention is to provide a microwave oven driving circuit wherein an output level of a magnetron is decreased from a high level to a low level by stages when it is necessary to decrease the output level of the magnetron so that the output of the latter can be continuously generated.

To achieve the above-mentioned objects, the present invention provides a microwave oven driving circuit comprising: a microcomputer; a key-input portion for inputting data to the microcomputer necessary for operation of the microwave oven; a power supply portion for full-rectifying a power supply, inverting the full-rectified dc voltage, boosting the dc voltage on the basis of mutual induction of a transformer and supplying the boosted voltage to a load; a generating portion for receiving the voltage passed through the transformer in the power supply portion and generating ultrahigh frequency needed for cooking; a first comparing portion enabling the voltage induced in a primary of the transformer in the power supply portion to change under a control of the microcomputer; a second comparing portion for determining an output value of the generating portion; and a switching portion controlled by the microcomputer for connecting th first and second comparing portions.

BRIEF DESCRIPTION OF THE DRAWINGS

The invention may be understood by reference to the following description taken in conjunction with the accompanying drawings, in which.

DETAILED DESCRIPTION OF THE PREFERRED EMBODIMENT

Hereinafter, a preferred embodiment of the present invention will be described in detail with reference the accompanying drawings.

Figure 1:
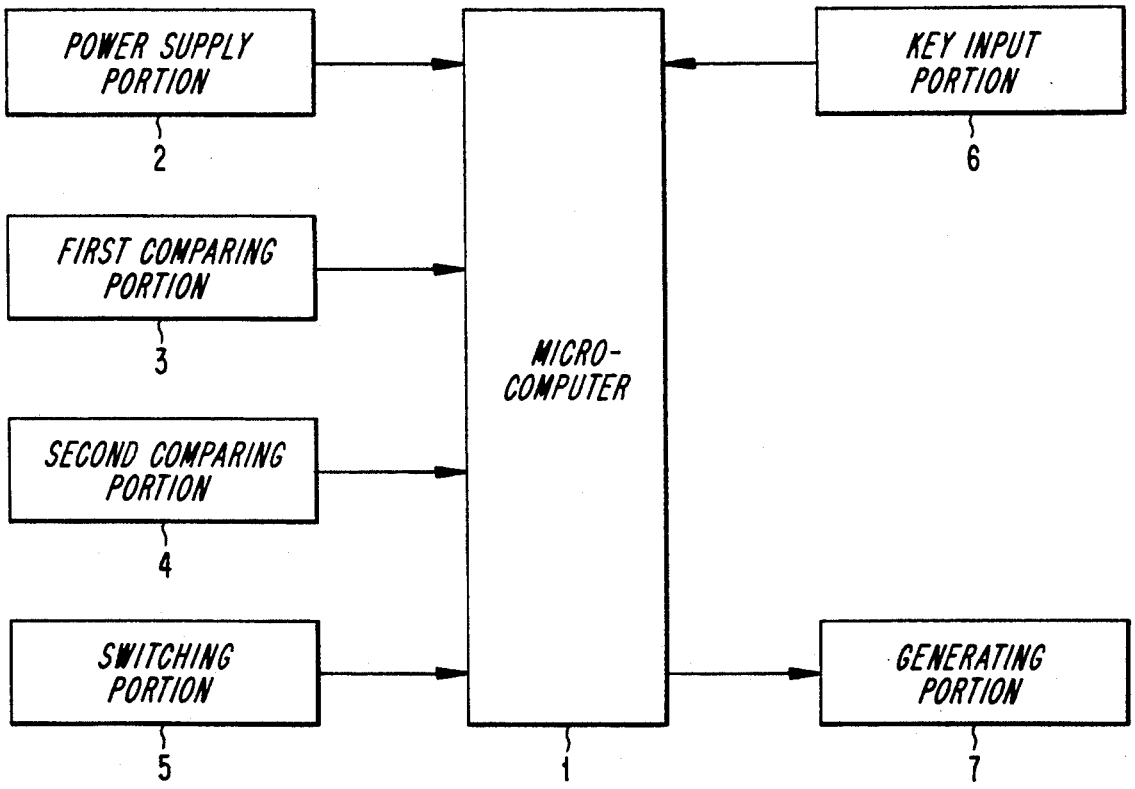
FIG. 1 is a block diagram of a microwave oven driving circuit according to the present invention.
Figure 2:
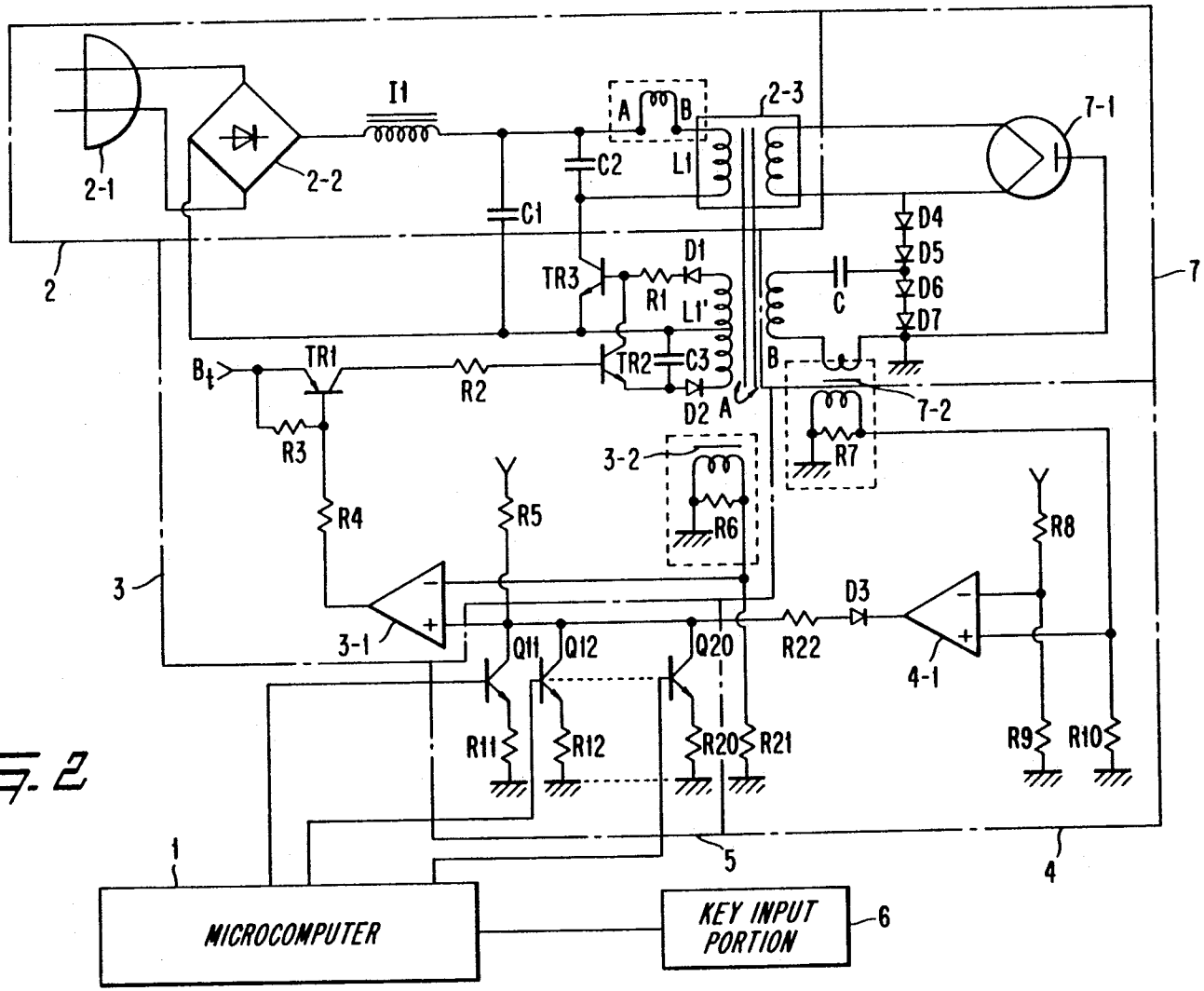
FIG. 2 is a detailed circuit diagram of FIG. 1.

In FIGS. 1 and 2, 1 denotes a microcomputer and 2 denotes a power supply portion which rectifies a common ac power supply, inputted via a plug 2-1, by means of a bridge diode set 2-2 and a smoothing capacitor C1, and supplies the rectified voltage to a magnetron 7-1 through a line filtering inductor $I_1$ and a transformer 2-3.

3 denotes a first comparing portion which indicates in voltage an amount of a primary current of the transformer 2-3 changed by passing through a current transformer 3-2 connected to nodes A and B to the power supply portion 2. The voltage is compared with a reference voltage, changed under the control of the microcomputer, by means of a comparator 3-1 and, consequently, a determination is performed from the compared result whether the voltage induced on the primary side of the transformer 2-3 is enough to operate the magnetron.

4 denotes a second comparing portion which determines whether the voltage applied from the transformer 2-3 of the power supply portion 2 is a voltage, i.e., a threshold voltage, by which the normal output of the magnetron 7-1 can be generated Also, 5 denotes a switching portion which cooperates with a resistor R22 connected to an output terminal of the second comparing portion 4 to change a comparison voltage supplied to a non-inverting input terminal "+" of the comparator 3-1. The switching portion 5 comprises a plurality of transistors Q11 to Q20 and a plurality of resistors R11 to R20 connected to respective emitters of the transistors Q11 to Q20 and is controlled by means of the microcomputer 1. 6 denotes a key-input portion which inputs data of a cooking program to operate the microwave oven, namely, inputting data for controlling the output of the magnetron into the microcomputer 1.

7 denotes a generating portion which receives a voltage supplied from the transformer 2-3 and generates ultrahigh frequency. The generating portion 7 generally comprises a magnetron 7-1, a capacitor C2 and diodes D4 to D7.

Now, operation of the embodiment thus constructed will be described.

First, a common ac voltage supplied through the plug 2-1 of the power supply portion 2 is full-rectified by the diode bridge 2-2 to obtain a rectified dc voltage. Ripple components contained in the full-rectified dc voltage are removed by using the line filtering inductor I and the smoothing capacitor $C_1$. The ripple component-removed dc voltage is applied to the primary winding $L_1$ of the transformer 2-3. At this time, the dc voltage is instantaneously supplied to other primary winding $L_1$, whereby an impulse current flows on the winding $L_1'$, The impulse current is applied to a transistor TR3 through a diode $D_1$ resistor and a $R_1$ so that a LC parallel resonance circuit comprising the primary winding $L_1$ and a resonance capacitor $C_2$ is operated to direct the primary current onto the primary winding L.

Consequently, the primary current flows through the primary coil of the current transformer 3-2 which is connected between nodes indicated by reference numerals A and B in FIG. 2. Therefore, a secondary current induced by mutual induction flows in a secondary coil of the current transformer 3-2. As a result, at both ends of a resistor R6, a voltage appears which corresponds to the level of the primary current of the transformer 2-3.

The voltage thus induced is divided by a resistor R21 and the divided voltage is thus applied to an inverting input terminal "−" of the comparator 3-1 as a comparison voltage.

Next, a description will be made with reference to the second comparing portion 4. When a voltage is induced to the second winding of the transformer, a primary current flows through a circuit including the magnetron 7-1, diodes D4 to D7 and a current transformer 7-2. At this time, on the primary coil of the current transformer 7-2, an induced current derived by mutual induction flows thereon. As a result, a voltage having a magnitude corresponding to that of the driving current of the magnetron 7-1 is formed at the ends of a resistor R7.

After the induced voltage thus derived is divided by means of a resistor R10, the divided voltage is inputted to a non-inverting terminal "+" of a second comparator 4-1 which has an inverting terminal "−" set to a reference voltage so that the divided voltage is compared with the reference voltage, i.e., a voltage being set as a threshold voltage of the magnetron.

As a result, when the reference voltage is larger than the voltage corresponding to the output of the magnetron 7-1, i.e., the voltage detected from the current transformer 7-2, it means that the magnetron 7-1 is still in an abnormal generating condition. On the other hand, when the voltage detected on the current transformer 7-2 is larger than the reference voltage, it means that the normal output of the magnetron 7-1 is generated.

Accordingly, in case that the magnetron 7-1 is in the former condition, the comparator 4-1 produces an output signal of a low level. Alternatively, in case that the magnetron is in the later condition, the comparator 4-1 outputs a high level signal. The high or low level output signal from the comparator 4-1 is applied to a non-inverting input terminal "+" of a first comparator 3-1 of the first comparing portion 3 through the switching portion 5, which is controlled by the microcomputer 1.

Here, the voltage supplied to the non-inverting terminal "+" of the first comparator 3-1 is changed according to the operation of the switching portion 5 which is controlled by the microcomputer 1. Therefore, it is noticed that the voltage supplied to the non-inverting input terminal "+" of the first comparator 3-1 can be changed according to the control of the microcomputer 1.

More particularly, in the switching portion 5 which is controlled by the microcomputer 1, a plurality of transistors Q11 to Q20 are coupled in parallel with each other and commonly connected to the non-inverting input terminal "+" of the first comparator 3-1. Also, the emitters of the transistors Q11 to Q20 are correspondingly connected to the resistors R11 to R20 which are coupled in parallel with a resistor R22 connected to the output terminal of the second comparator 4-1.

Accordingly, if the second comparator 4-1 is assumed to be short-circuit with a low level output thereof, the resistance of the non-inverting input terminal "+" of the first comparator 3-1 is changed based on the number of the conducted switching transistors Q11 to Q20 and, consequently, the divided voltage formed in the switching portion 5 is changed.

For example, if the transistor Q11 is rendered conductive under the control of the microcomputer 1, the combined resistance of parallel-connected resistors R22 and R11 is set to the non-inverting input terminal "+" of the comparator 3-1. Moreover, if another transistor Q12 is rendered conductive by way of the control of the microcomputer 1 while the transistor Q11 being rendered conductive, the combined resistance derived from the parallel-connected resistors R22, R11 and R12 is set to the non-inverting input terminal of the comparator 3-1. In this case, the resistance is lower than that in case of the parallel resistors R22 and R11 and the voltage to be divided by the resistors R22, R11 and R12 is decreased. Therefore, as the number of the conducting transistors is increased, the value of the entire resistance is relatively reduced and the voltage to be divided is also decreased.

Meanwhile, if the number of conducting transistor is decreased, the divided voltage is relatively increase and thus the output of the comparator 3-1 is at a high level, so that the continued ON or OFF of transistor TR3 is repeatedly performed to allow the output level of the transformer to be increased.

Alternatively, if the number of conducting transistors as determined by the control of the microcomputer 1 is increased, the divided voltage is reduced and, consequently, the output of the comparator 3-1 remains at a low level. In this condition, the transistors TR1 and TR2 are successively rendered conductive to stop the operation of the transistor TR3. As a result, the output of the transformer 2-3 is decreased in level.

The course of increasing the output of the transformer 2-3 is effected at the initial operating stage of the microwave oven, but the course of decreasing the output of the transformer 2-3 is effected in a case that the output of the magnetron must be gradually decreased on the basis of the cooking program stored in the microcomputer 1, which will be described later with reference to a flowchart shown in FIG. 3.

Figure 3:
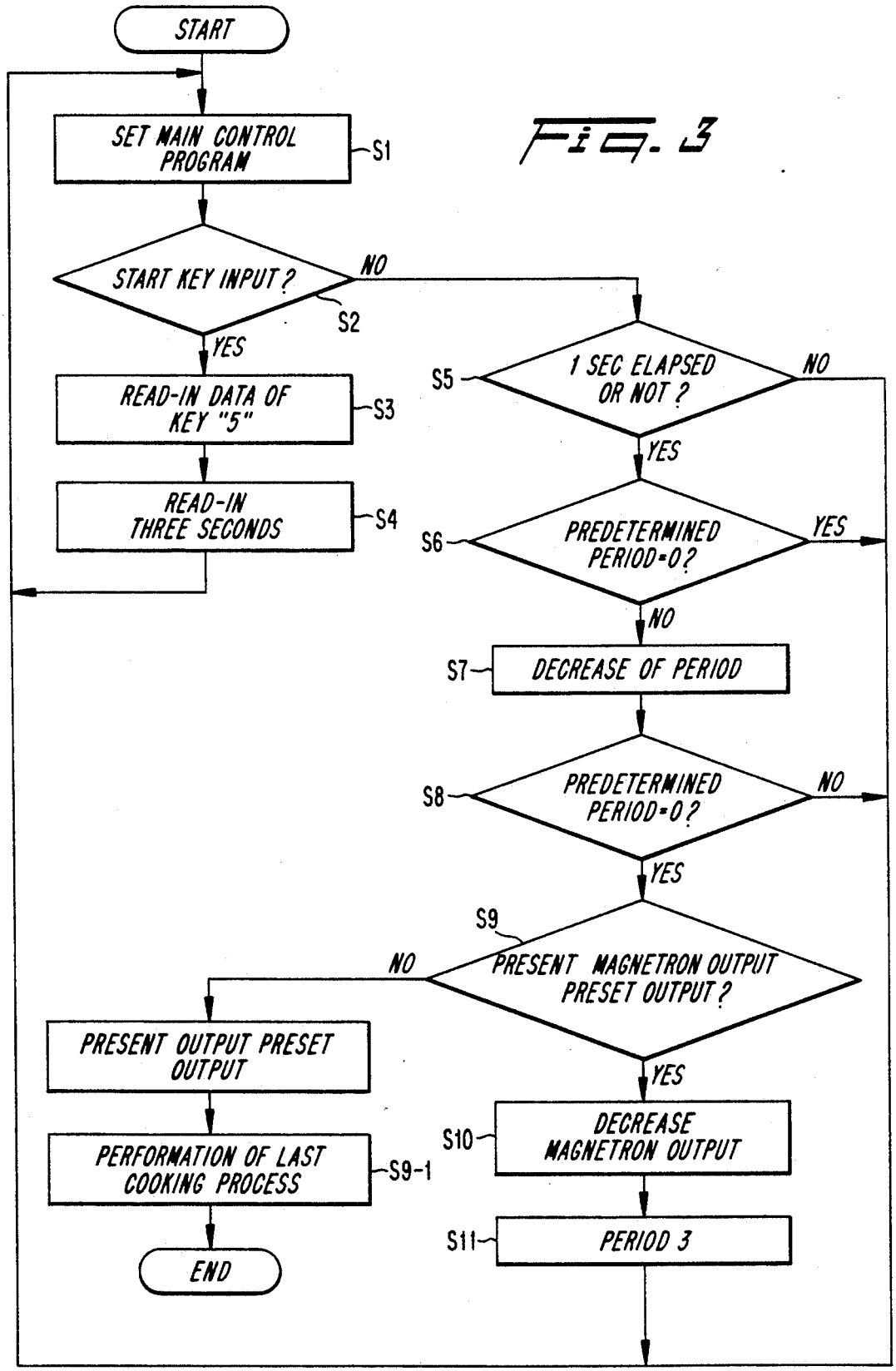
FIG. 3 is a flowchart illustrating an operation sequence according to the present invention.

FIG. 3 shows a course of increasing the output of the magnetron 7-1 at the initial operating stage of the microwave oven, in which S denotes steps.

When a program provides that, the output of the magnetron 7-1 is 600 W at an initial step, and then decreased to 450 W, 300 W and 150 W with the lapse of every three seconds (that is, time necessary for each cooking stage) and then maintained to 150 W level so as to complete the cooking process after remaining time was elapsed (preset by means of a key "5" in the key input portion 6), the output of the magnetron 7-1 is controlled accordingly.

That is, at a step S1, if the main control program according to the present invention is effected, a determination whether a start key for operating the microwave oven is pressed or not is performed at a step S2. As a result, if the start key is pressed, the output value of the magnetron 7-1 corresponding to the key "5" on the basis of the cooking program which is set by an user is read-in at a step S3. At a step S4, the predetermined periodic time, for example, three seconds for each cooking stage is read-in according to the program and a control is returned to the step S1 to perform the main control program. Under that condition, at a step S2, if the start key is not pressed again in order to effect other cooking process, the microcomputer 1 determines whether or not one second has been elapsed while continuously preforming the cooking process, at a step S5.

At the step S5, if one second is not elapsed, under the initial output 600 W of the magnetron 7-1, the control is returned to the step S1 to continuously count the predetermined time.

If one second was elapsed, at the step S5, the microcomputer 1 determines whether the predetermined period, for example, three seconds needed to gradually decrease the output of the maqnetron for each cooking stage is concluded at a step S6. If the period is not zero at step S6, control is advanced to a step S7. At this step S7, the predetermined period is decreased by one second.

Subsequently, at a step S8, a determination is made as to whether the period decreased at the step S7 is zero. If the period is not zero, it means that three seconds have not elapsed. Therefore, control is returned to the step S1 to repeatedly perform the main control program. Alternatively, if the period is zero by decreasing the period by one second, the control is advanced to a step S9 to compare the present output of the magnetron and the output level of the last cooking stage of the magnetron 7-1.

When the present output of the magnetron 7-1 is larger than the last-stage output level thereof, the output level of the magnetron is decreased to the level in next cooking stage. This is a step of controlling the switching portion 5 shown in FIG. 2. More particularly, if the switching transistor Q11 is turned ON, the divided voltage is decreased and the primary current of the transformer 2-3 is also decreased, thereby allowing the output of the magnetron 7-1 to be decreased by a predetermined value.

Namely, as described in the embodiment, the output of the magnetron is decreased from the initial output of 600 W to the output of 450 W and then the predetermined period, for example, three seconds, is counted, at a step S11.

If the output of the magnetron is decreased according to the aforementioned steps and the present output of the magnetron 7-1 is same as the last cooking stage output there at the step S9, a control is advanced to a step S9'. At this step S9', the last constant period is counted and, at step S9-1, the last cooking process is continuously performed.

As described above, according to the microwave oven driving circuit of the present invention, since the output of the magnetron is smoothly changed in the cooking process performed by the microwave oven, the cooking can be excellently effected. Also, since the output of the magnetron can be appropriately generated according to the cooking steps, it is possible to prolong the expected life of the magnetron.

What is claimed is:

1. A driving circuit comprising:

a power supply portion including a transformer having a primary coil and a secondary coil for outputting power;

a generating portion, electrically connected to receive power output from said secondary coil of said transformer, for generating an ultrahigh frequency;

a first comparing portion, electrically connected to said primary coil of said transformer, for comparing a voltage proportional to a current in said primary coil of said transformer to a first threshold voltage and for generating an output to control said output of said secondary coil of said transformer;

a second comparing portion, electrically connected to an output of said generating portion, for comparing said output of said generating portion to a second threshold value, wherein said first threshold voltage includes an output of said second comparing portion, which is an input of said first comparing portion; and a switching portion, electrically connected to said second comparing portion, capable of selectively setting said first threshold voltage to control said output of said secondary coil of said transformer, wherein said switching portion increases the output of said secondary coil of said transformer at an initial operating stage of said generating portion, and decreases the output of said secondary coil of said transformer in accordance with a program stored in said switching portion.

2. A driving circuit according to claim 1, wherein said switching portion includes a microprocessor.

3. A driving circuit according to claim 2, further comprising key-input portion for inputting data to control said microprocessor.

4. A driving circuit according to claim 1, wherein said generating portion includes a magnetron.

5. A driving circuit according to claim 1, wherein said power supply portion includes a full rectifier.

6. A driving circuit according to claim 1, wherein said switching portion comprises a group of transistors and a plurality of resistors connected to respective transistors.

7. A driving circuit according to claim 1, wherein said first comparing portion compares an inverted voltage proportional to a current in said primary coil of said transformer and the output voltage of said second comparing portion.

* * * * *